US008919350B1

(12) United States Patent
Hsu

(10) Patent No.: US 8,919,350 B1
(45) Date of Patent: Dec. 30, 2014

(54) HAIR COMB

(71) Applicant: Shih-Ling Hsu, Tainan (TW)

(72) Inventor: Shih-Ling Hsu, Tainan (TW)

( * ) Notice: Subject to any disclaimer, the term of this patent is extended or adjusted under 35 U.S.C. 154(b) by 0 days.

(21) Appl. No.: 13/921,854

(22) Filed: Jun. 19, 2013

(51) Int. Cl.
*A45D 24/04* (2006.01)
*A45D 24/00* (2006.01)

(52) U.S. Cl.
CPC ..... *A45D 24/00* (2013.01)
USPC ..... 132/142

(58) Field of Classification Search
USPC ..... 132/218–219, 141–142, 160, 107, 126, 132/137, 320; 15/159.1, 160
See application file for complete search history.

(56) References Cited

U.S. PATENT DOCUMENTS 3,346,901 A * 10/1967 Fay ..... 15/160
6,546,937 B2 * 4/2003 Gueret ..... 132/218
8,181,304 B1 * 5/2012 Kamath ..... 15/160
2008/0271746 A1 * 11/2008 Gueret ..... 132/218
2012/0167323 A1 * 7/2012 Williams ..... 15/160

* cited by examiner

*Primary Examiner* — Todd Manahan
*Assistant Examiner* — Brianne Kalach

(57) ABSTRACT

Disclosed is a hair comb capable of reducing the resistance and improving the smoothness of combing hair, and the hair comb includes a slab-shaped main body, a plurality of parallel slash-shaped teeth implant areas disposed on a surface of the main body, a plurality of serial comb teeth sequentially implanted in the teeth implant areas and disposed opposite to the slash-shaped teeth implant areas respectively, a vacant area without any implanted tooth and disposed on a surface of the main body and the width of the vacant area falling between the serial comb teeth is greater than the distance between two adjacent comb teeth to achieve the effects of reducing the resistance of combining hair by the hair comb and the occurrence of tangled hair and providing a smooth combing operation.

1 Claim, 5 Drawing Sheets

HAIR COMB

FIELD OF THE INVENTION

The present invention relates to a hair comb, and more particularly to the hair comb for combining hair but not for curling hair.

BACKGROUND OF THE INVENTION

Various hair combing tools are used in our daily life, and comb is one of the popular hair combing tools as well as a necessary tool particularly for women with long hair. There are different types of combs available in the market, and these combs are basically divided into linear single-plate hair combs, planar blade combs and cylindrical combs, wherein the linear single-plate comb has a combing section extended from an end of a handle and including a plurality of equidistant comb teeth; the blade comb has a combing section extended from an end of a handle and including alternate longitudinal and transversal comb teeth; and the cylindrical comb has a combing section extended from an end of a handle and including a plurality of comb teeth columns implanted in the circumferential surface of the cylindrical comb. Regardless of the types of combs, users may find it difficult to comb the hair due to the large resistance, or the hair may be tangled or even worse torn by the gaps between comb teeth easily. The main reasons to be blamed are the design of arranging the comb teeth at transversal and longitudinal positions of the hair comb, and the too-small distance between each comb tooth and its adjacent comb tooth, and thus the comb teeth are arranged alternately in a high density. In FIG. 5, the distance between each comb tooth 50 and its adjacent comb tooth 50 of the hair comb 5 is too small, so that the hair may be tangled by the gaps between the comb tooth 50 and its adjacent comb tooth 50 or the hair may be torn easily during the process of combing hair, and such design of the hair comb 5 is obviously not good enough. If manufacturers increase the gap between the comb teeth 50 to reduce the resistance of combing hair, such design will not be able to meet the requirement of attaching the hair properly for the hair combing effect, and thus this design is also not good enough. In view of the aforementioned drawbacks of the conventional hair comb having a large resistance that causes an unsmooth combing operation or even tears hair, the inventor of the present invention based on years of experience in the related industry to conduct extensive researches and experiments, and finally develop a hair comb of the invention to overcome the drawbacks of the prior art.

SUMMARY OF THE INVENTION

Therefore, it is a primary objective of the present invention to provide a hair comb comprising a slab-shaped main body, a plurality of parallel slashed-shaped teeth implant areas disposed on a surface of the main body, at least two serial parallel teeth columns implanted in the teeth implant areas and aligned in a slash-shaped direction, and a vacant area without any implanted comb tooth and disposed on a surface of the main body and opposite to the slash-shaped teeth implant area, wherein the vacant area is also aligned in the slash-shaped direction and has a width greater than the distance between two adjacent teeth columns. With the structural configuration of the slash-shaped vacant area and the plurality of serial teeth columns implanted in the slash-shaped teeth implant areas, users can reduce the resistance and improve the smoothness of combining hair.

The technical characteristics, contents, advantages and effects of the present invention will be apparent with the detailed description of a preferred embodiment accompanied with related drawings as follows.

DESCRIPTION OF THE PREFERRED EMBODIMENTS

Figure 1:
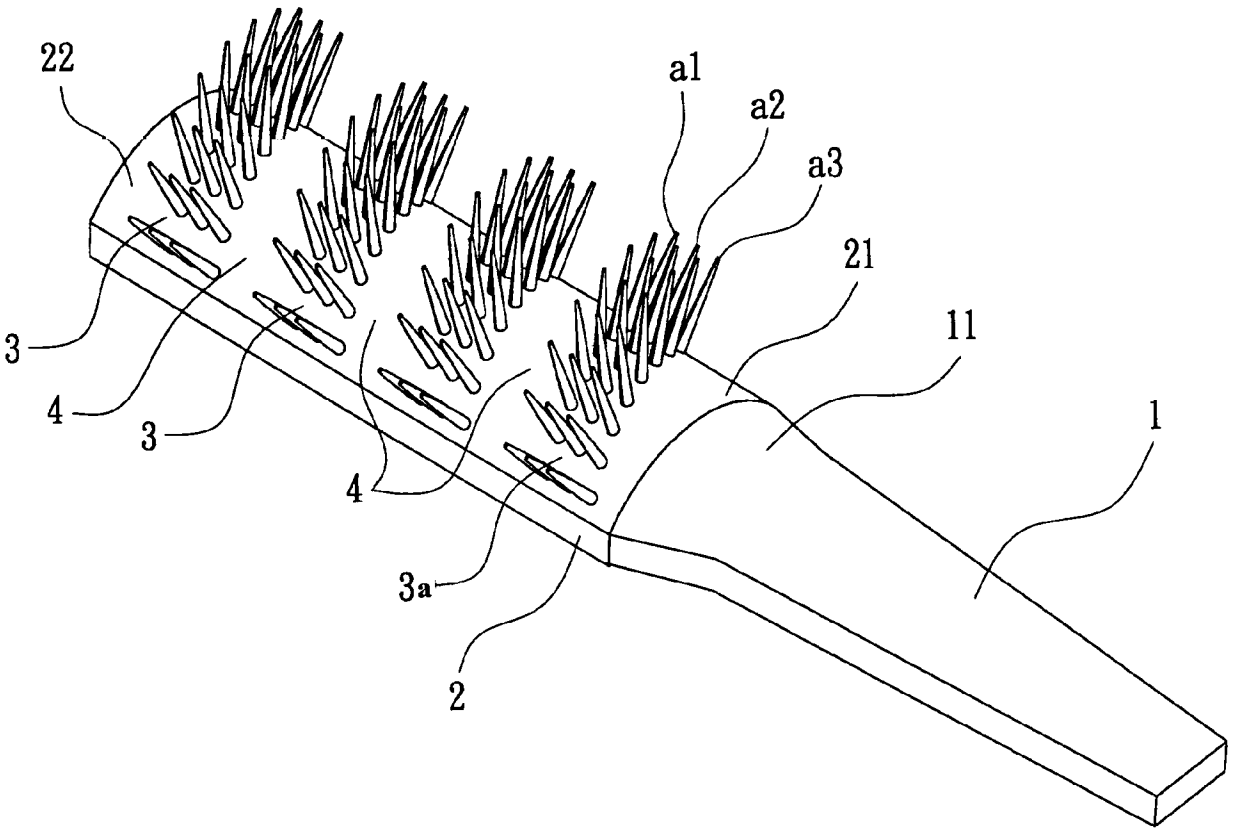
FIG. 1 is a perspective view of a hair comb of the present invention.
Figure 2:
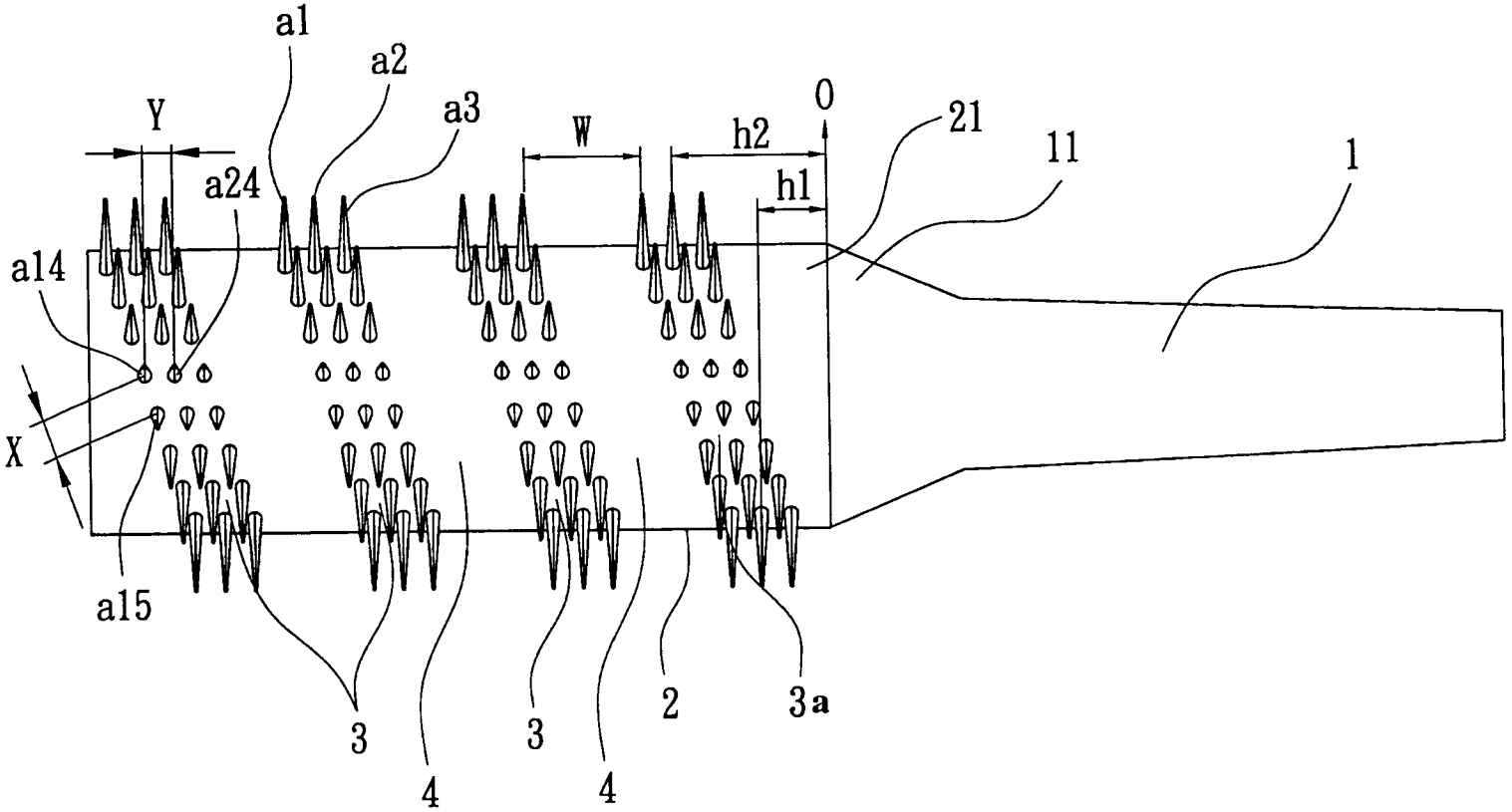
FIG. 2 is a planar view of a hair comb of the present invention.

With reference to FIGS. 1 and 2 for a hair comb of the present invention, the hair comb comprises a handle section 1, a slab-shaped main body 2 extended directly from a joining end 11 of the handle section 1, a plurality of parallel slashed-shaped teeth implant areas 3 disposed on a surface of the slab-shaped main body and arranged in a direction from a starting end (i.e. in the direction from the reference line O of the first end 21 to the second end 22), wherein the distance H2 from an end of the teeth implant area 3*a* proximate to the reference line O is greater than the distance H1 from the other end of the teeth implant area 3*a*, and at least two comb teeth columns implanted in the teeth implant areas 3. In a preferred embodiment of the present invention, the plurality of serially parallel comb teeth columns a1, a2, a3 are disposed opposite to the slash-shaped teeth implant areas 3, and a vacant area 4 is defined on a surface of the main body 2 without any implanted comb tooth, and the vacant area 4 disposed between the serial comb teeth has a width W greater than the distance Y between any two adjacent comb teeth columns of the comb teeth columns, and the width W is greater than the distance X between two comb teeth in the same comb teeth column. In FIG. 2, the width W is greater than the distance X between the comb teeth a14, a15, and the width W is greater than the distance Y between the comb teeth a14, a24.

Figure 3:
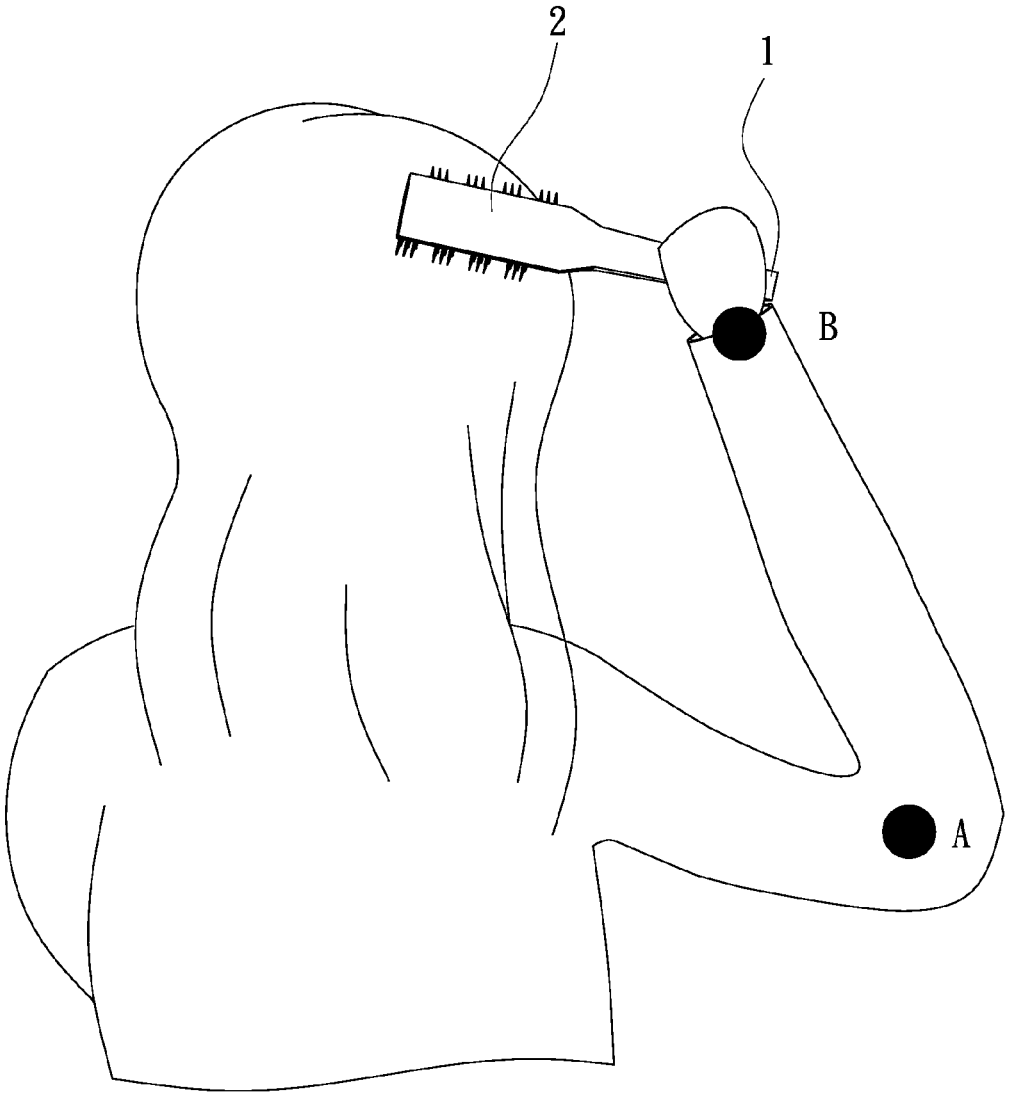
FIGS. 3 and 4 are schematic views of motions of combing hair in accordance with the present invention.
Figure 4:
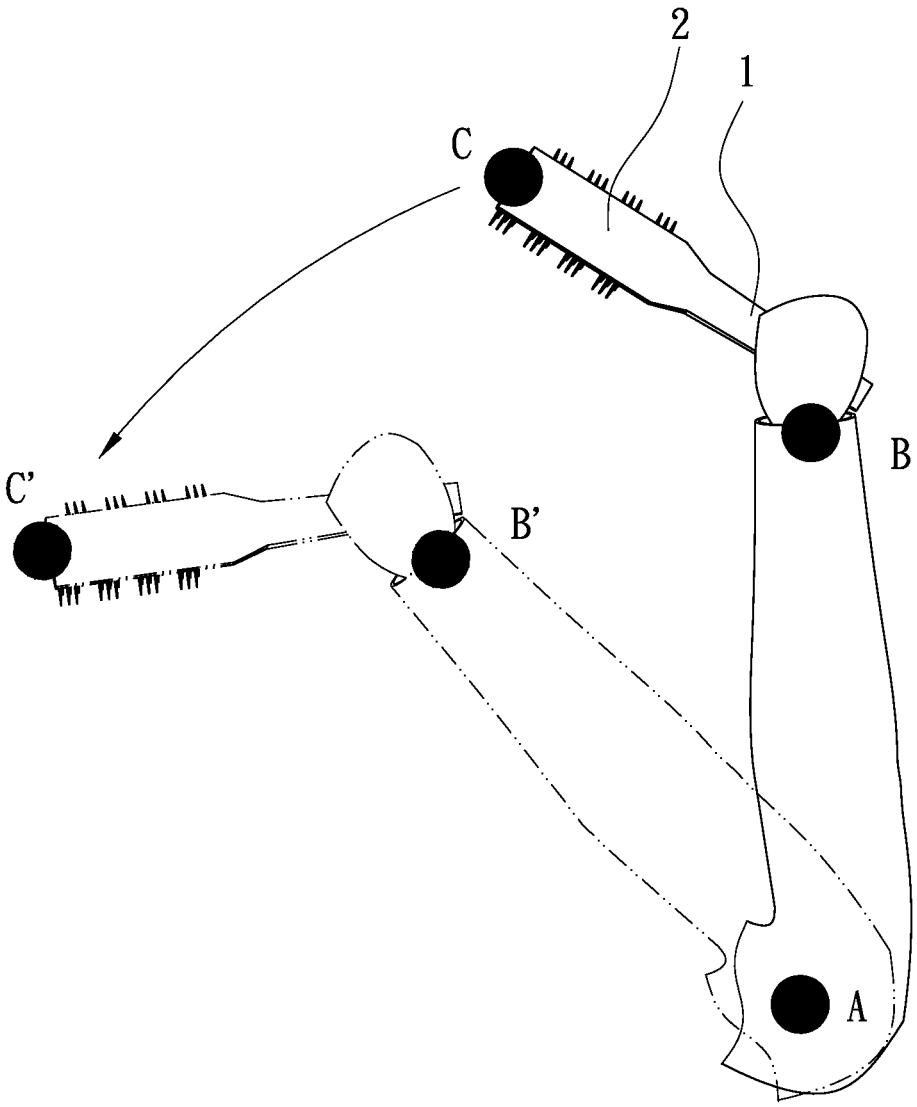
Figure 5:
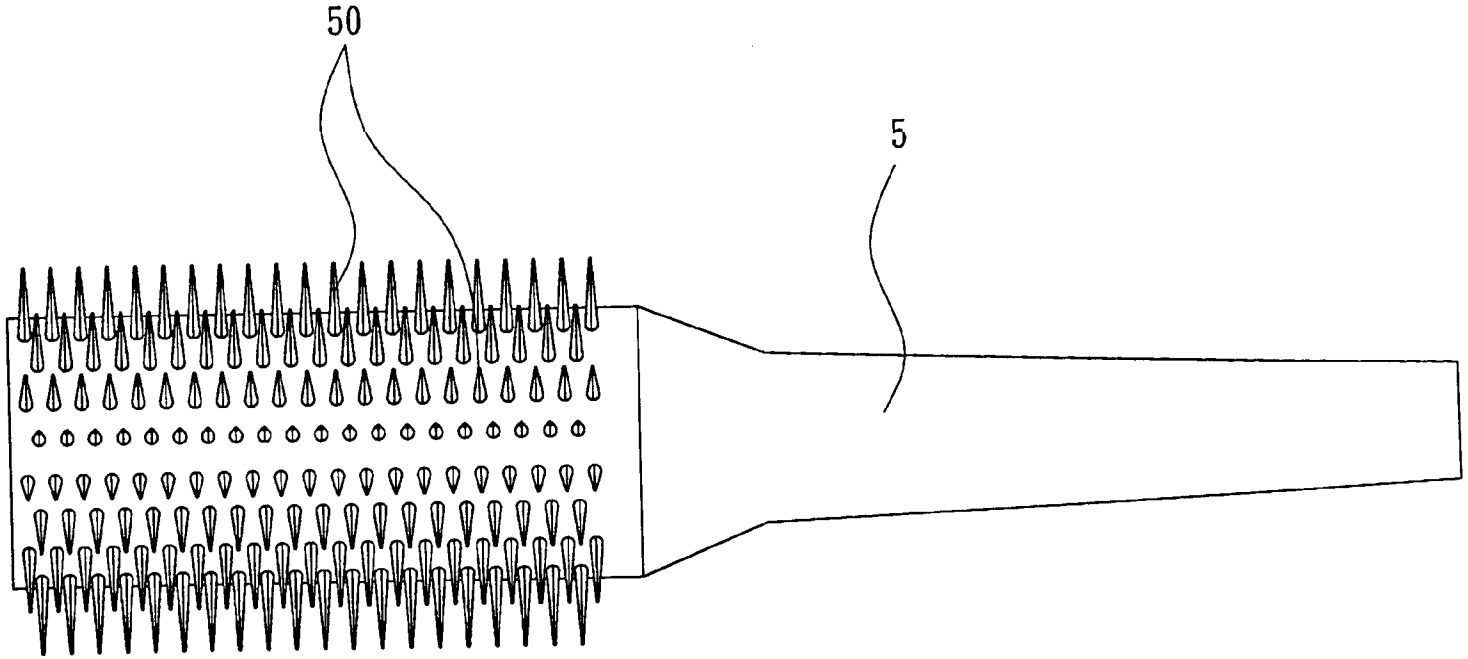
FIG. 5 (Prior Art)
FIG. 5 is a planar view of a conventional hair comb.

During the process of combing hair, a user's hand movement is generally an arc movement, and the user's arm is moved up and down in an arc or wavy direction, so that the hair comb is also moved in the arc or wavy direction. In FIGS. 3 and 4, the user's elbow joint is Point A, the user's wrist joint is Point B, and the second end 22 of the hair comb is Point C. The arc movement of combing hair is shown in FIG. 4. Therefore, the main body 2 of the present invention has a greater width W to form the vacant area 4 in the slash-shaped direction, wherein the slash-shaped direction is an arc direction capable of attaching the user's hair with the hair comb in the hair combing operation. The plurality of comb teeth columns a1, a2, a3 in the teeth implant area 3 are also slash-shaped, wherein the slash-shaped direction refers to an arc direction capable of attaching the user's hair with the hair comb in the hair combing operation. Since the teeth implant area 3 and the vacant area 4 of the present invention come with the slash-shaped structural design and are substantially aligned in the same direction as the arc direction of the combing movement of the hair comb, therefore the hair comb of the present invention can reduce the resistance and improve the smoothness of the combing operation. The invention not only avoids tangling hair with the comb teeth, but also avoids tearing hair.

In summation of the description above, the hair comb of the present invention has a plurality of parallel slashed-shaped teeth implant areas 3 disposed on the slab-shaped main body 2 and a plurality of comb teeth columns a1, a2, a3 implanted in the teeth implant area 3 and also aligned in the slash-shaped direction, so that the resistance of combing hair can be reduced significantly. The main body 2 of the hair comb of the present invention has a large width W to have a continuous slash-shaped vacant area 4, so that the smoothness of the combing operation can be improved to avoid tangling or tearing hair. Obviously, the present invention is novel and inventive.

What is claimed is:

1. A hair comb, comprising:

a handle section;

a slab-shaped main body, directly extended from a joining end of the handle section, confined by a first end connecting the joining end, a second end parallel to the first end, an upper end, and a lower end parallel to the upper end, including a plurality of teeth implant areas (A1, A2, . . . ), separated from each other by one of vacant areas, disposed in parallel over the main body from the first end to the second end of the slab-shaped main body; wherein the teeth implant areas extend across the main body from the upper end to the lower end; where a distance from an end of the teeth implant area to the first end is greater than the distance from an opposing end of the implant area to the first end;

at least two comb teeth columns, disposed in parallel in each of the slash-shaped teeth implant areas, with each comb teeth column including comb teeth, a comb tooth $b_1$ disposed at the upper end in a distance $h_2$ away from a vertical reference line closest to the first end and perpendicular to a central horizontal axis of the slab-shape main body, and a comb tooth $b_8$ is disposed at the lower end in a distance $h_1$ away from the vertical reference line, wherein both the comb tooth $b_1$ and $b_8$ are disposed in a middle line position in a slash-shaped teeth implant area $A_1$ closest to the vertical reference line, W is defined as a shortest distance between two comb teeth disposed in different comb teeth columns implanted in different slashed-shaped teeth implant areas, and $h_1<W<h_2$; and the vacant areas, defined on the surface of the main body without any comb teeth implanted within, wherein x is defined as a shortest distance between any two comb teeth in the same comb teeth column, and y is defined as a shortest distance between any two adjacent comb teeth in two different comb teeth columns, and $y<W$, and $x<W$.

* * * * *